US009228722B2

(12) United States Patent
Wu

(10) Patent No.: US 9,228,722 B2
(45) Date of Patent: Jan. 5, 2016

(54) OUTDOOR LED LIGHTING DEVICE STRUCTURE WITH EASY INSTALLATION FEATURES

(71) Applicant: Ming-Yuan Wu, Taipei (TW)

(72) Inventor: Ming-Yuan Wu, Taipei (TW)

( * ) Notice: Subject to any disclaimer, the term of this patent is extended or adjusted under 35 U.S.C. 154(b) by 148 days.

(21) Appl. No.: 14/037,372

(22) Filed: Sep. 26, 2013

(65) Prior Publication Data

US 2015/0085502 A1 Mar. 26, 2015

Related U.S. Application Data

(63) Continuation-in-part of application No. 13/910,239, filed on Jun. 5, 2013, now abandoned.

(51) Int. Cl.
*F21V 29/00* (2015.01)
*F21V 15/01* (2006.01)

(52) U.S. Cl.
CPC ..... *F21V 15/011* (2013.01)

(58) Field of Classification Search
CPC ..... F21V 15/011; F21V 29/02
USPC ..... 362/431, 382, 418, 419
See application file for complete search history.

(56) References Cited

U.S. PATENT DOCUMENTS

| | | | | |
|---|---|---|---|---|
| 7,614,766 | B2 * | 11/2009 | Wang et al. | 362/269 |
| 8,092,045 | B2 * | 1/2012 | Xiao et al. | 362/249.02 |
| 8,152,336 | B2 * | 4/2012 | Alexander et al. | 362/249.11 |
| 8,414,178 | B2 * | 4/2013 | Alexander et al. | 362/655 |
| 8,419,209 | B2 * | 4/2013 | Mai | 362/217.14 |
| 8,888,325 | B2 * | 11/2014 | Thomas et al. | 362/249.02 |
| 2008/0089071 | A1 * | 4/2008 | Wang | 362/294 |
| 2011/0002132 | A1 * | 1/2011 | Park | 362/429 |
| 2011/0032696 | A1 * | 2/2011 | Kim et al. | 362/184 |
| 2012/0162987 | A1 * | 6/2012 | Liu et al. | 362/249.02 |
| 2014/0085909 | A1 * | 3/2014 | Ahn | 362/382 |

* cited by examiner

*Primary Examiner* — Ali Alavi

(57) ABSTRACT

An outdoor LED lighting device includes a casing, a light emitting module, a driver module and a supporter. This LED lighting device may be installed easily by the supporter in a housing of the conventional outdoor lamp without having to discard the whole set of the conventional outdoor lamp, thus eliminating the unnecessary waste, in achieving cost-effectiveness and environment protection. Also, the LED lighting device has good characteristics of thermal dissipation and waterproof. Moreover, the solar battery module may be included to lower environmental impact without carbon dioxide emissions during power generation.

6 Claims, 23 Drawing Sheets

OUTDOOR LED LIGHTING DEVICE STRUCTURE WITH EASY INSTALLATION FEATURES

RELATED-APPLICATIONS

This application is a continuation-in-part of U.S. patent application Ser. No. 13/910,239, filed Jun. 5, 2013. This application claims priority to all the above-referenced applications.

BACKGROUND OF THE INVENTION

1. Field of Invention

The present invention relates to a light-emitting diode (LED) lamp and a street lamp using the same, and, more particularly, but not exclusively to an outdoor LED lighting device structure with easy installation features.

2. Related Art

As a solid state light source, LEDs (light-emitting diodes) are a product with long life span, firm structure, low power consumption and flexible dimension such that they are becoming to take the place of conventional high pressure halide lamps in a wide range of lighting applications. However, LEDs would generate comparatively high heat energy, with a result of their high light fades and shortened life span. This leads to limited applications of LEDs to some extent.

Legacy street lighting systems are based on high pressure discharge lamps, most commonly high pressure sodium (HPS) lamps. These have been generally recognized to give the highest amount of lighting per watt of electricity used. New street lighting technologies, such as Light Emitting Diode (LED) and Induction lighting, emit a white light that provides high levels of scotopic lumens allowing street lights with lower wattages and lower photopic lumens to replace existing street lights.

When the outdoor lamp is exposed to outside for a long period of time, the fixing screws may be gradually eroded. Thus, rain or snow may creep through clearances between the screws and the housing of the outdoor lamp, and enter into the housing to thereby cause electrical short circuit and potential safety problems. Also, when the LED lamp is lightened over a long period of time, the heat generated by the LED would accumulate in the LED lamp and could not be effectively removed therefrom, bringing the LED to burn out due to overheat.

Presently, great efforts have been made to provide various solutions in an attempt to tackle the heat dissipation of the LED lighting fixtures. However, these solutions are either less effective to dissipate the heat, or are expensive and structurally complicated though being effective on heat dissipation. Therefore, replacement of conventional street lamps with LED lamps requires both improving their thermal dissipation with low costs and providing an improved waterproof structure that can be used outdoors for longer periods of time with improved durability and high safety.

SUMMARY OF THE INVENTION

The present invention overcomes the above-described and other problems and disadvantages in the prior art by providing an outdoor LED light device to easily replace the conventional outdoor lamps, such as garden lights, path lights, street lights, wall lights or the like.

An object of the present invention is to provide a heat dissipation mechanism and a waterproof structure for outdoor LED lighting device to achieve excellent heat dissipation and waterproof effects with cost down.

It is another objective of the present invention to provide the outdoor LED light device with simplified structure. The outdoor LED light device may be installed easily.

Accordingly, the present invention provides an outdoor LED (light emitting diode) lighting device including a casing, a light emitting module, a driver module and a supporter. A hollow space is provided in the casing and an auxiliary fin type heat sink is provided at an outer surface of the casing. The light emitting module is detachably disposed in the hollow space of the casing and contacted to the casing to dissipate heat generated by the light emitting module through the auxiliary fin type heat sink. The driver module is electrically connected to the light emitting module by a waterproof cable joint. The supporter is disposed on one end of the casing. Therefore, the LED lighting device may be installed easily by the supporter in a housing of the conventional outdoor lamp without having to discard the whole set of the conventional outdoor lamp, thus eliminating the unnecessary waste, in achieving cost-effectiveness and environment protection.

Also, the supporter may be a column-like structure or include a threaded rod and a connected block. Therefore, the LED lighting device may be easy to install the street light by the supporter and replace the conventional bulbs. Moreover, the solar battery module may be included to lower environmental impact without carbon dioxide emissions during power generation.

Moreover, the casing may be disposed directly in the housing of the conventional outdoor lamp, rather than via the supporter as above-mentioned. The outdoor LED lighting device further includes an illumination angle adjuster, disposed on the casing to modify the illumination angle of the light emitting module.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1A:
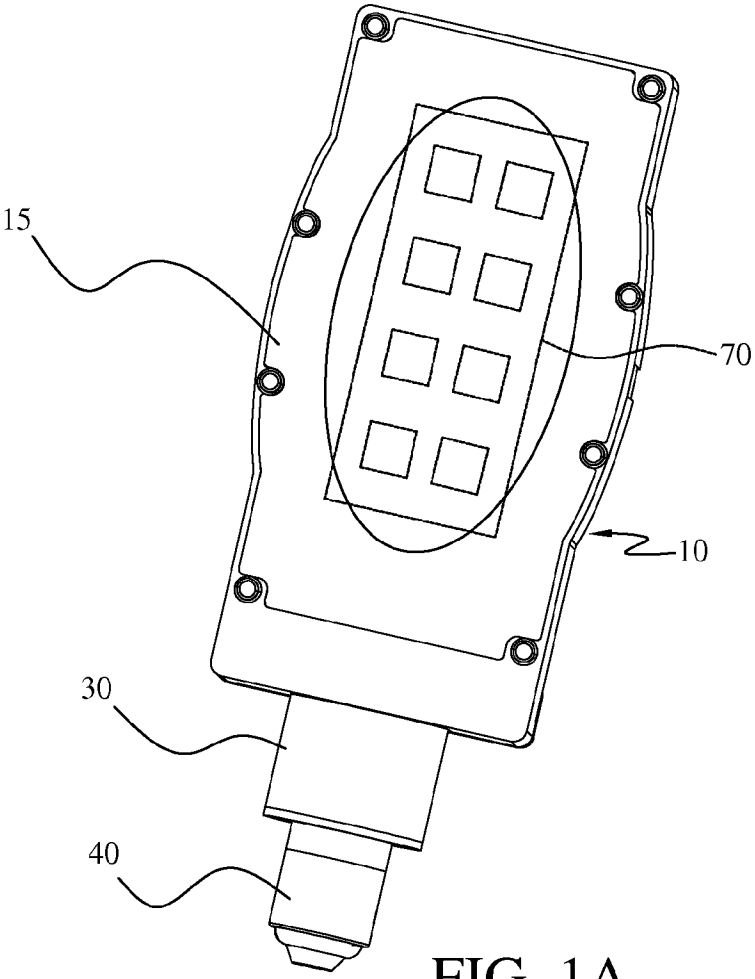
FIGS. 1A, 1B and 1C are perspective views of the outdoor LED lighting device of a first preferred embodiment of the present invention.
Figure 1C:
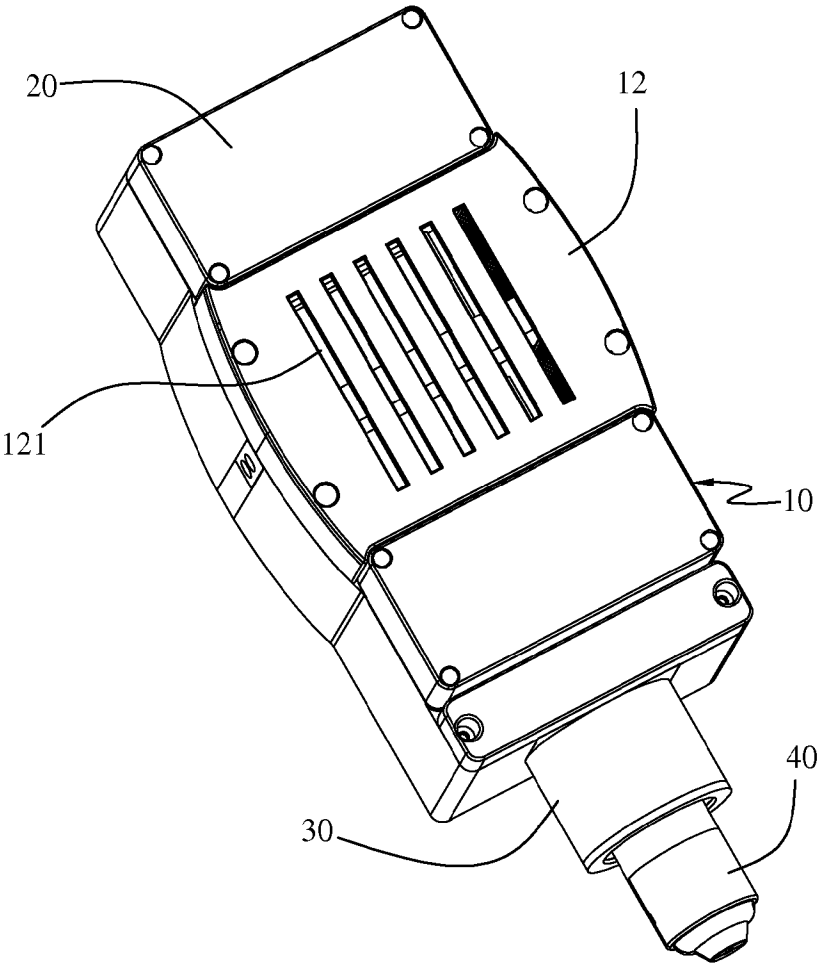
Figure 1B:
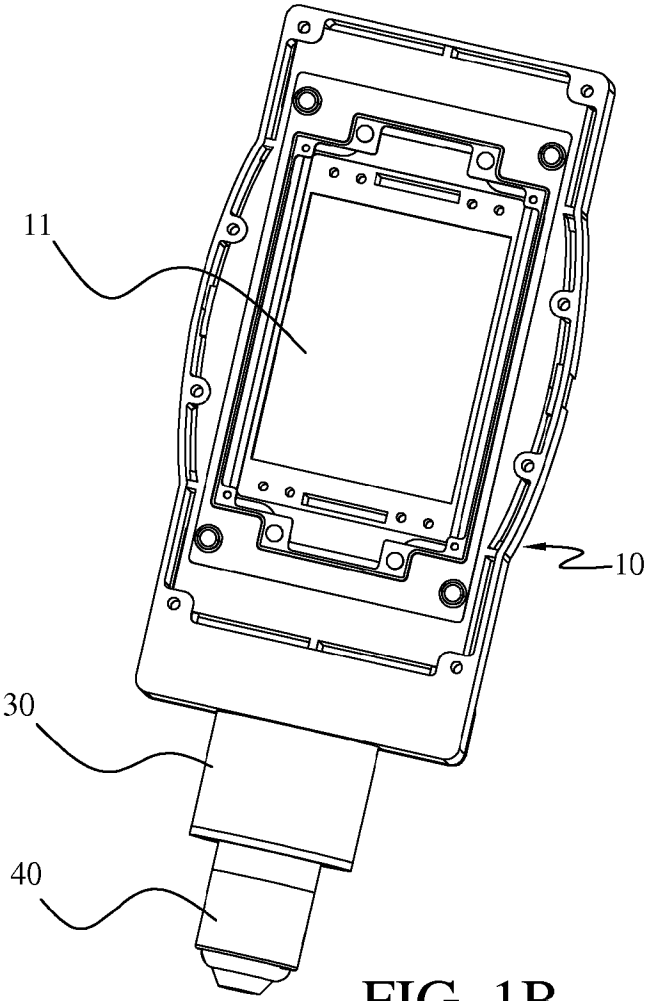

An outdoor LED (light emitting diode) lighting device of a first embodiment of the present invention is shown in FIGS. 1A, 1B to 1C. The outdoor LED lighting device including a casing 10, a light emitting module 70, a driver module 20 and a connecting module 30. A hollow space 11 is provided in the casing 10. The light emitting module 70 is detachably disposed in the hollow space 11 of the casing 10 and contacted to a radiator 60 disposed therein, also see FIG. 3B. The driver module 20 is detachably disposed in the casing 10 and adjacent to the light emitting module 70. The connecting module 30 is disposed on the casing 10 and electrically connected to the driver module 20 and a connecting base 40 of the conventional outdoor lamp to replace the conventional bulbs. The connecting module 30 may be detachable and changeable with different type to connect to the connecting base 40, such as screw type or plug type. As shown in FIG. 1A, the connecting module 30 and the connecting base 40 are plug type. Therefore, the LED lighting device may be installed in a housing of the conventional outdoor lamp without having to discard the whole set of the conventional outdoor lamp, thus eliminating the unnecessary waste, in achieving cost-effectiveness and environment protection.

A lamp cover 15 is disposed on the top of the casing 10 to protect the light emitting module 70. The waterproof element 151 is disposed between the casing 10 and the lamp cover 15. The waterproof element 151 includes a waterproof pad, a waterproof ring, a waterproof glue and etc. Also, the waterproof glue may be applied to connection section of the connecting base 40 and the connecting module 30 to ensure waterproof performance.

Figure 2A:
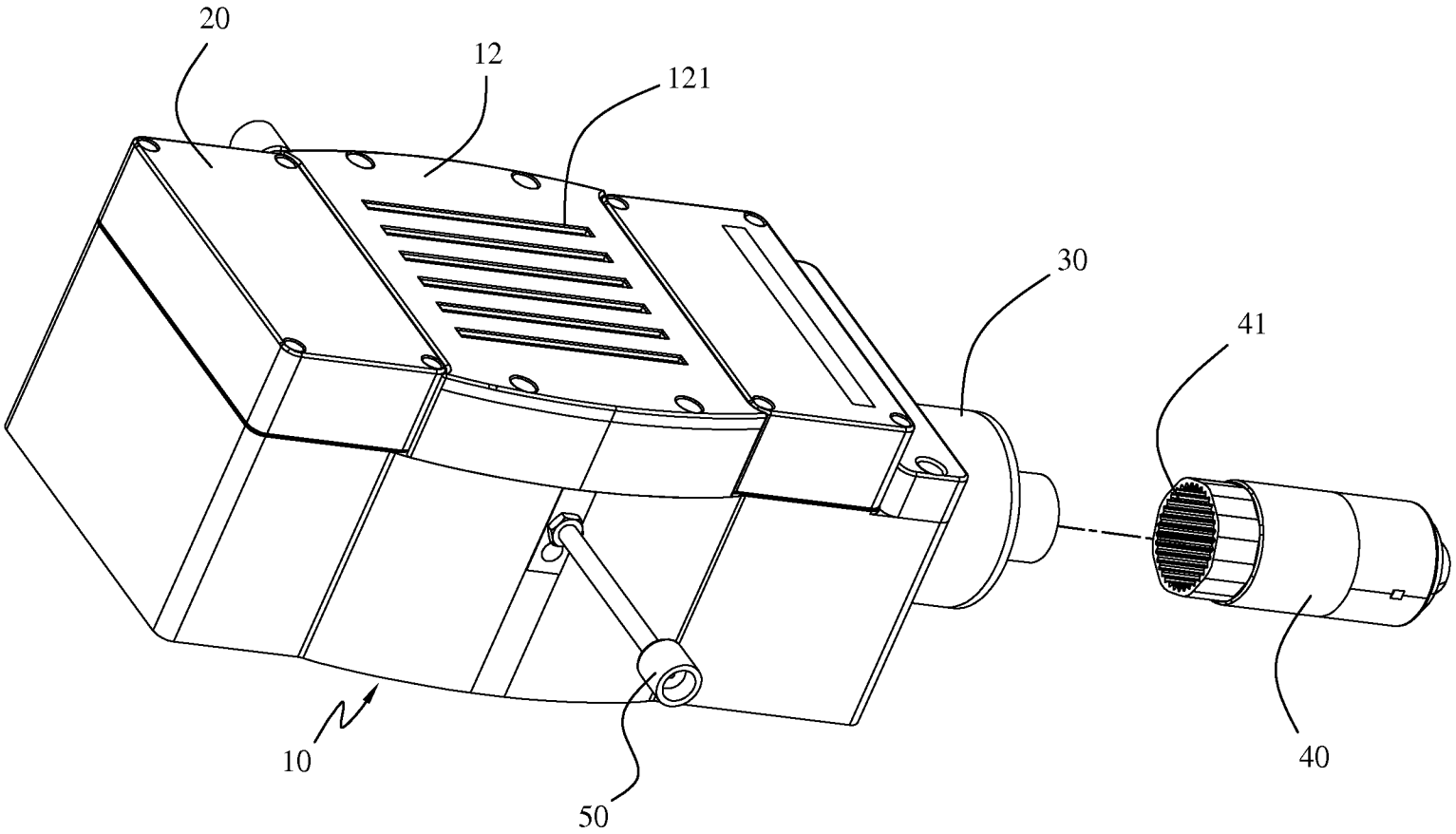
FIGS. 2A and 2B are schematic views of the outdoor LED lighting device of another preferred embodiment of FIG. 1A.
Figure 2B:
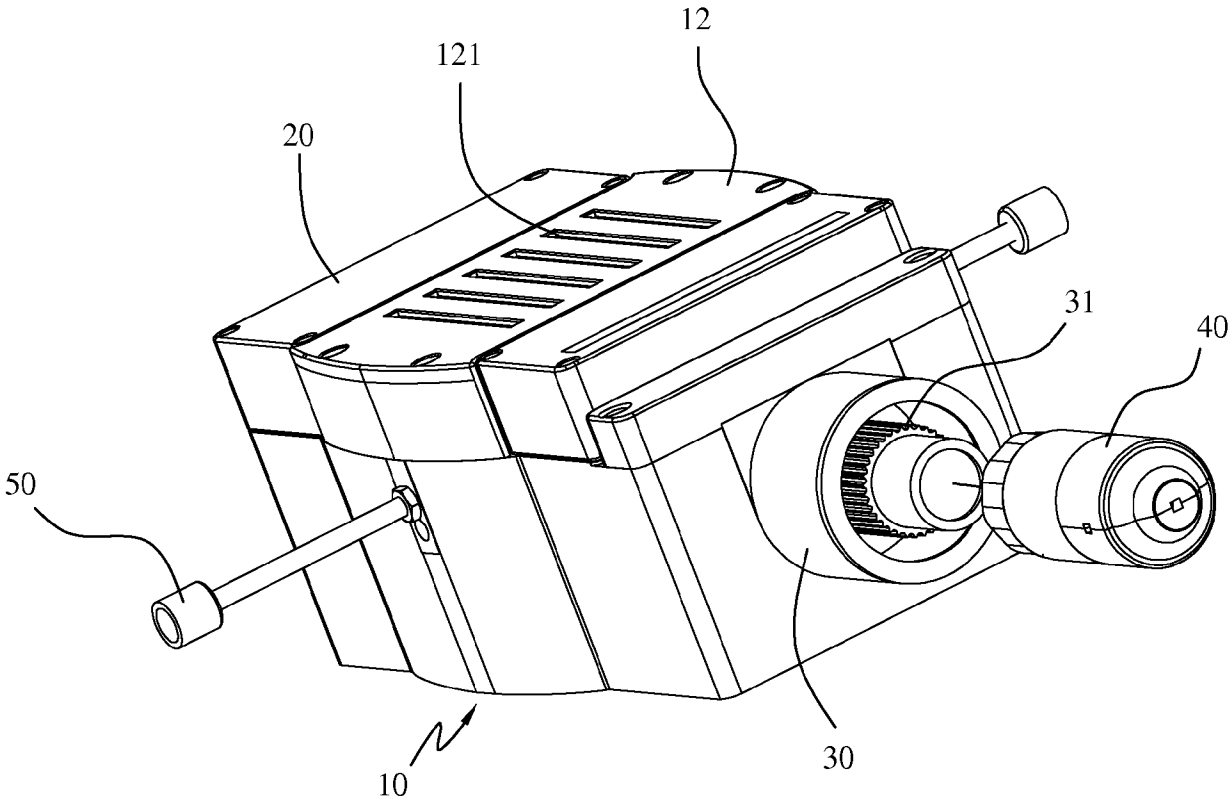

Please refer to FIGS. 2A and 2B, the casing 10 may further include two supporters 50 located at two side walls. The supports 50 are used to support and fix the outdoor LED lighting device in the housing of the conventional outdoor lamp. Moreover, a heat generated by the light emitting module 70 may be dissipated to the housing through the supports 50. A back cover 12 is disposed on the casing 10, and at lease one heat dissipating hole 121 is provided in the back cover 12. The heat dissipating hole 121 may quickly dissipate the heat generated by the light emitting module 70 to avoid overheating.

Figure 3A:
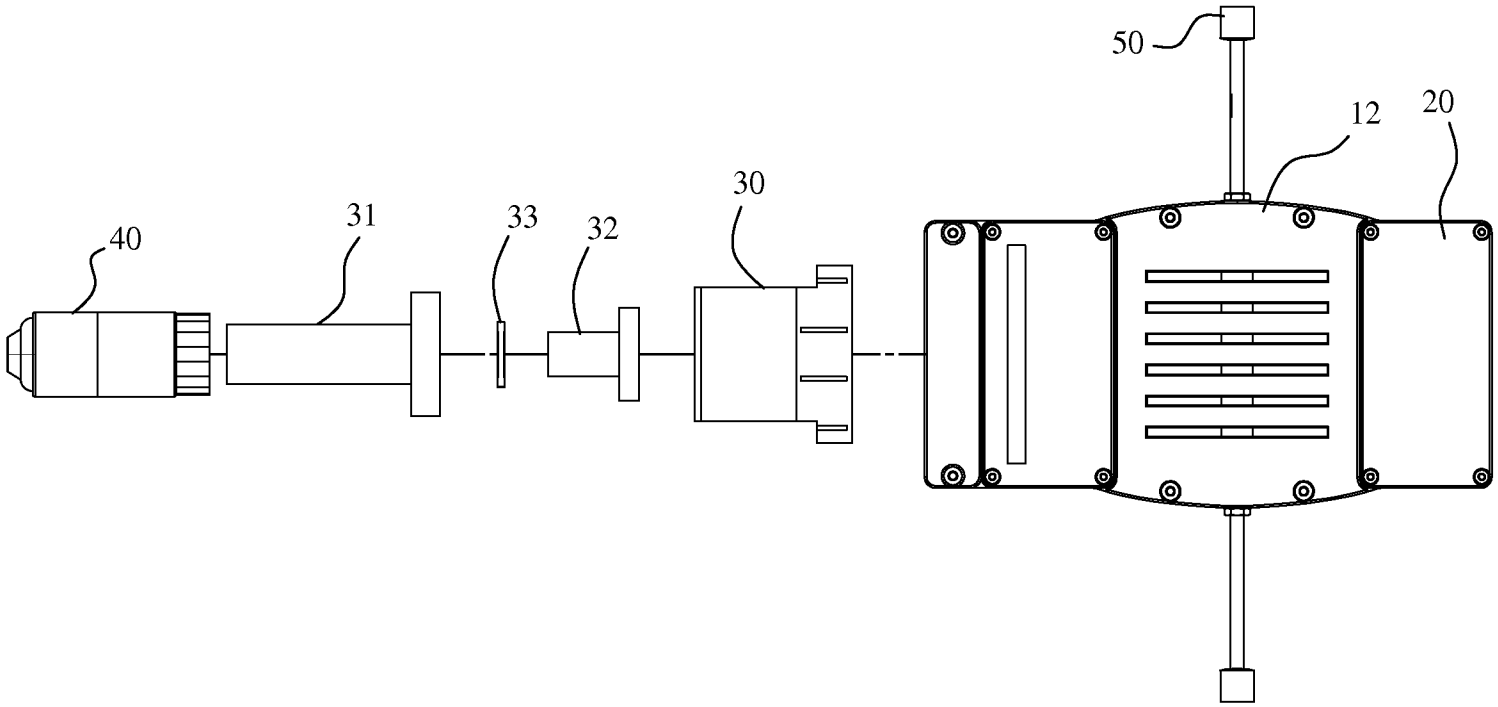
FIGS. 3A and 3B are exploded views of the outdoor LED lighting device of FIG. 2A.
Figure 3B:
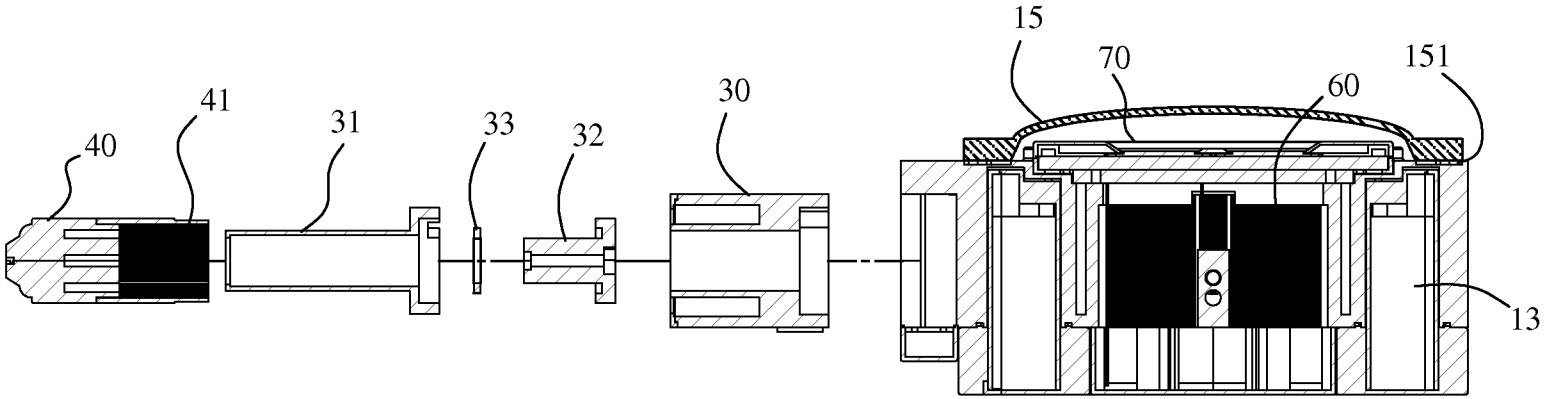

Please also refer to FIGS. 3A and 3B, the connecting module 30 includes a connecting end 31 and a collector ring 32. The connecting end 31 has a sawtooth-like outer surface to be physically connected to the connecting base 40. The connecting base 40 also includes a sawtooth-like inner surface 41 to be physically connected with the sawtooth-like outer surface of the connecting end 31. The collector ring 32 is electrically connected to the driver module 20 and the connecting base 40. The connecting base 40 is rotatable with respect to the connecting module 30 and maintains the electrical connection by the collector ring 32. Therefore, the outdoor LED lighting device whose angle may be adjusted according the actual need. Also, the waterproof element 33 is disposed between the connecting module 30 and the connecting base 40. The waterproof element 33 includes a waterproof pad, a waterproof ring, a waterproof glue and etc.

The casing 10 includes at least one side hollow space 13 to store the driver module 20. The driver module 20 is configured to receive input power from an AC power source such as a commercial power source or from a DC power source such as a battery, to convert the input power into required DC power, and output the required DC power to the light emitting module 70. The driver module 20 may also be adapted to control or regulate the total current for the light emitting module 70. The number of the driver module 20 may be varied according to the need. As shown in FIG. 3B, two driver modules 20 are disposed.

The driver module 20 is modular structure to enable rapid repair and maintenance. Also, the driver module 20 may be designed to a waterproof structure. Therefore, the outdoor LED lighting device may be used as a street light alone without being disposed the conventional housing. Due to the whole outdoor LED lighting device has excellent waterproof effect, the outdoor LED lighting device still works well after being exposed to outside for a long period of time.

Figure 4:
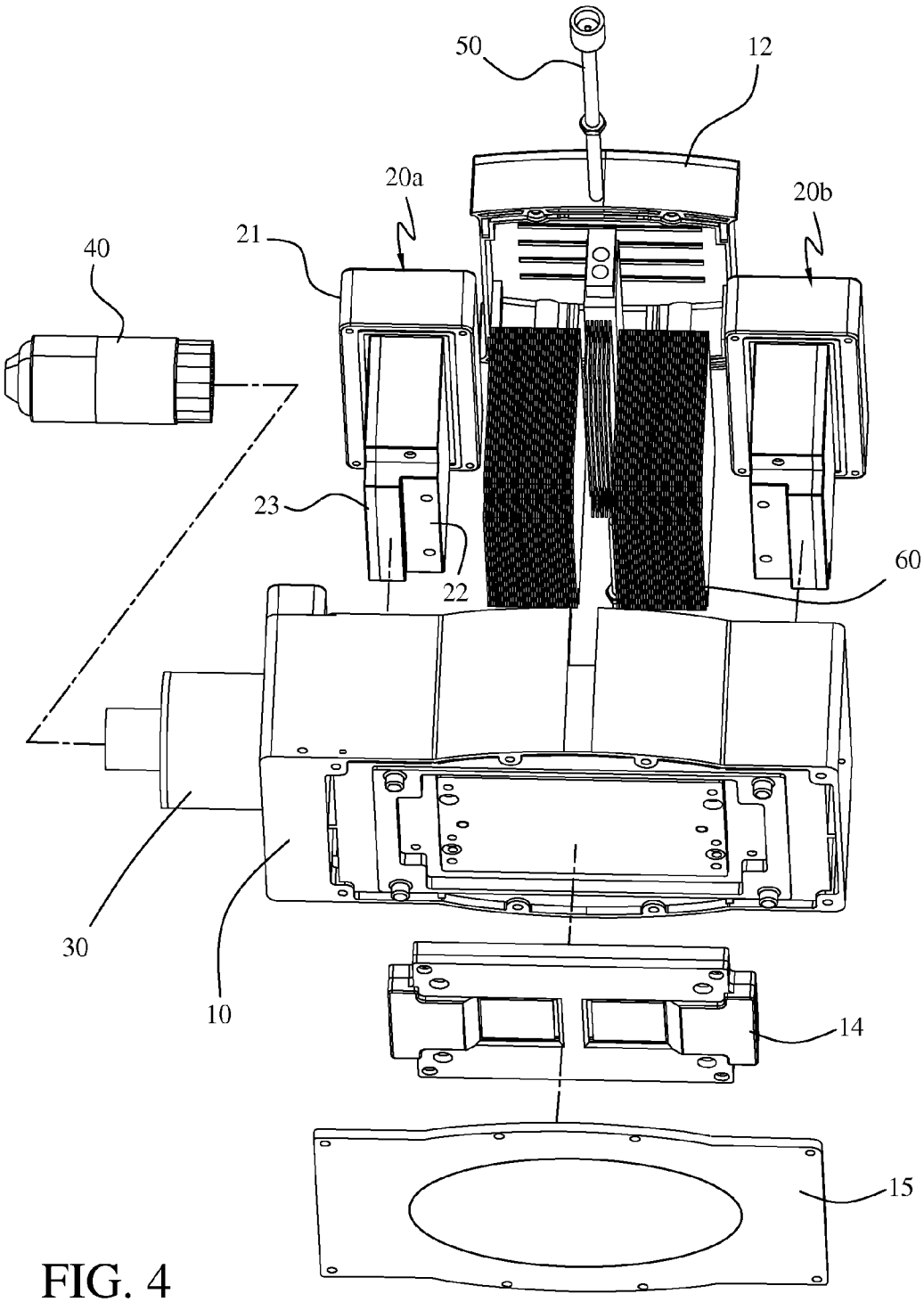
FIG. 4 is an exploded view of the outdoor LED lighting device of a second preferred embodiment of the present invention.
Figure 8A:
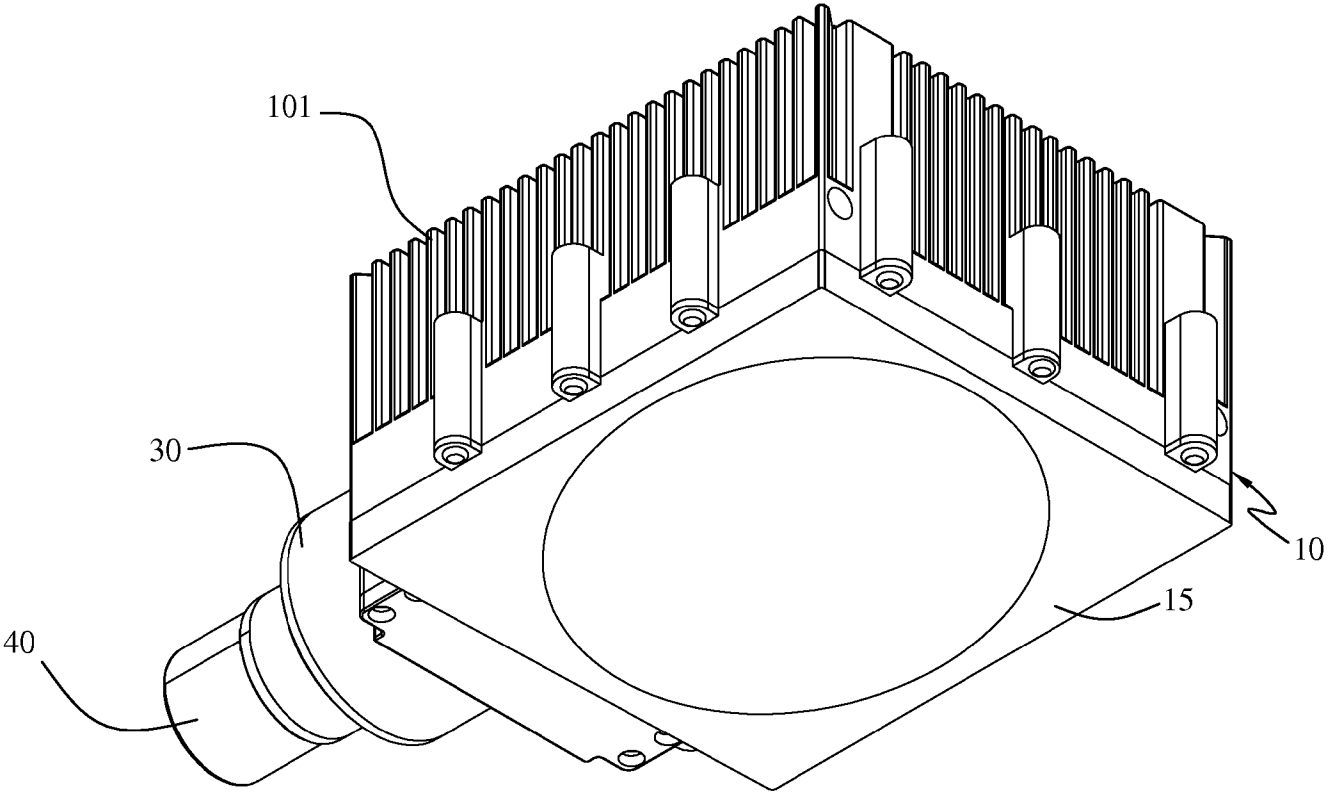
FIGS. 8A and 8B are schematic views of the outdoor LED lighting device of another preferred embodiment of the present invention.
Figure 8B:
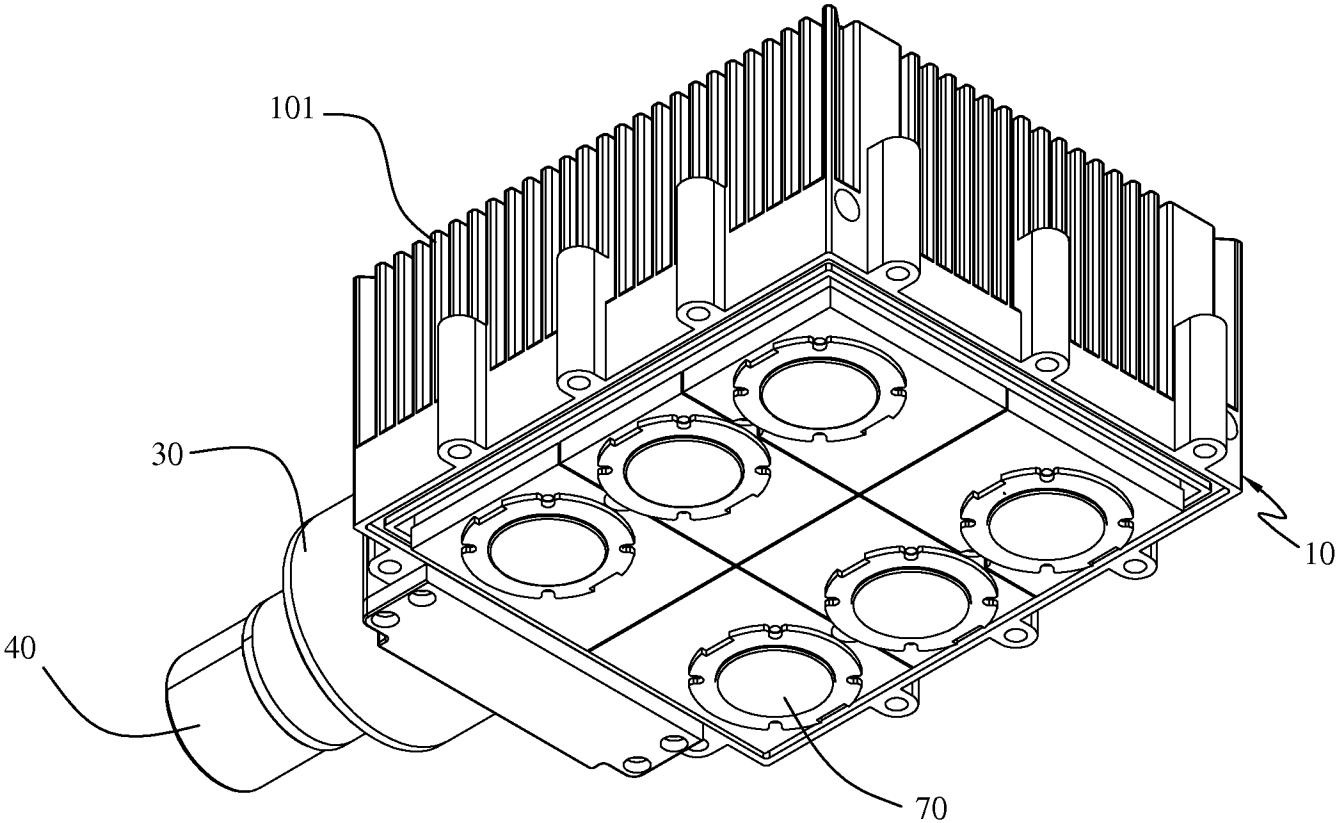

Please refer to FIG. 4, the radiator 60 is a fin type heat sink and disposed in the hollow space 11 of the casing 10. The radiator 60 may be formed by aluminum-alloy extruded material and disposed in the hollow space 11 by the thermal insulating pad with waterproof characteristic to give consideration to waterproof, heat dissipation and insulation. Please refer to FIGS. 8A and 8B, the outer surface of the casing 10 may further have an auxiliary fin type heat sink 101 to improve the heat dissipation effect.

The casing 10 may include a substrate 14 to connect the light emitting module 70. The driver modules 20*a*, 20*b* are composed of a driver cover 21, a driver shell 22 and a driver bottom 23.

Figure 5:
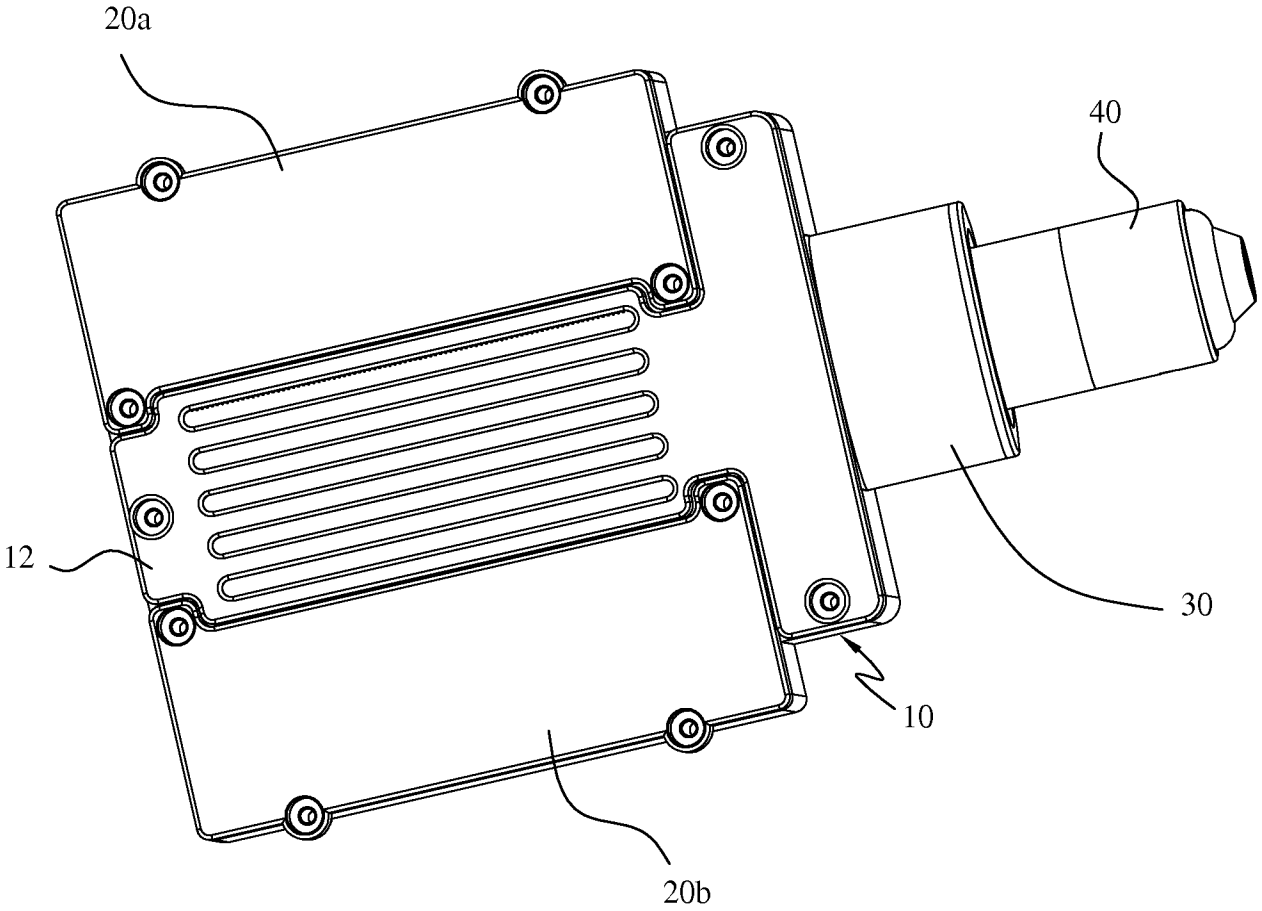
FIG. 5 is a perspective view of the outdoor LED lighting device of FIG. 4.
Figure 6:
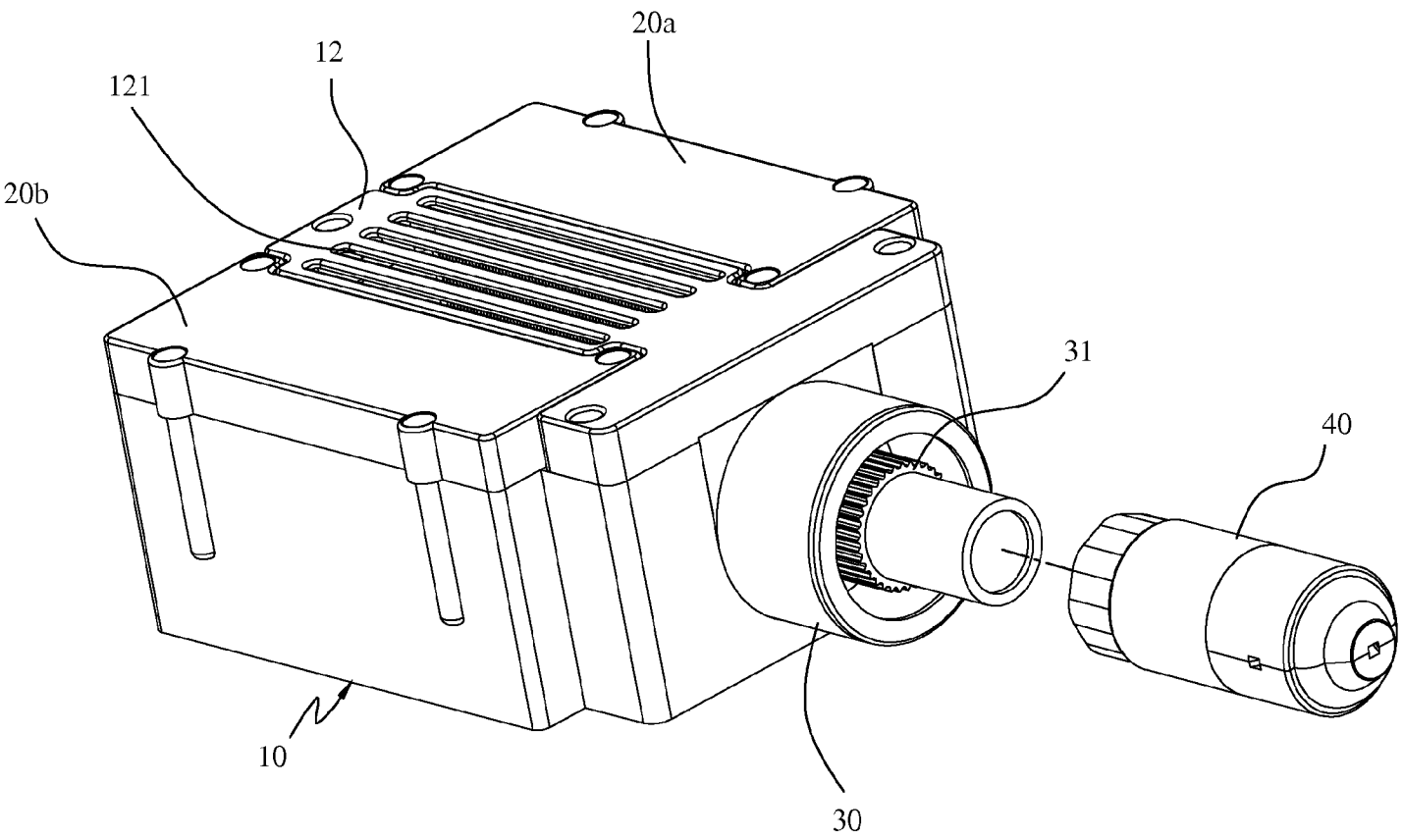
FIG. 6 is a perspective view of the outdoor LED lighting device of FIG. 4.
Figure 7:
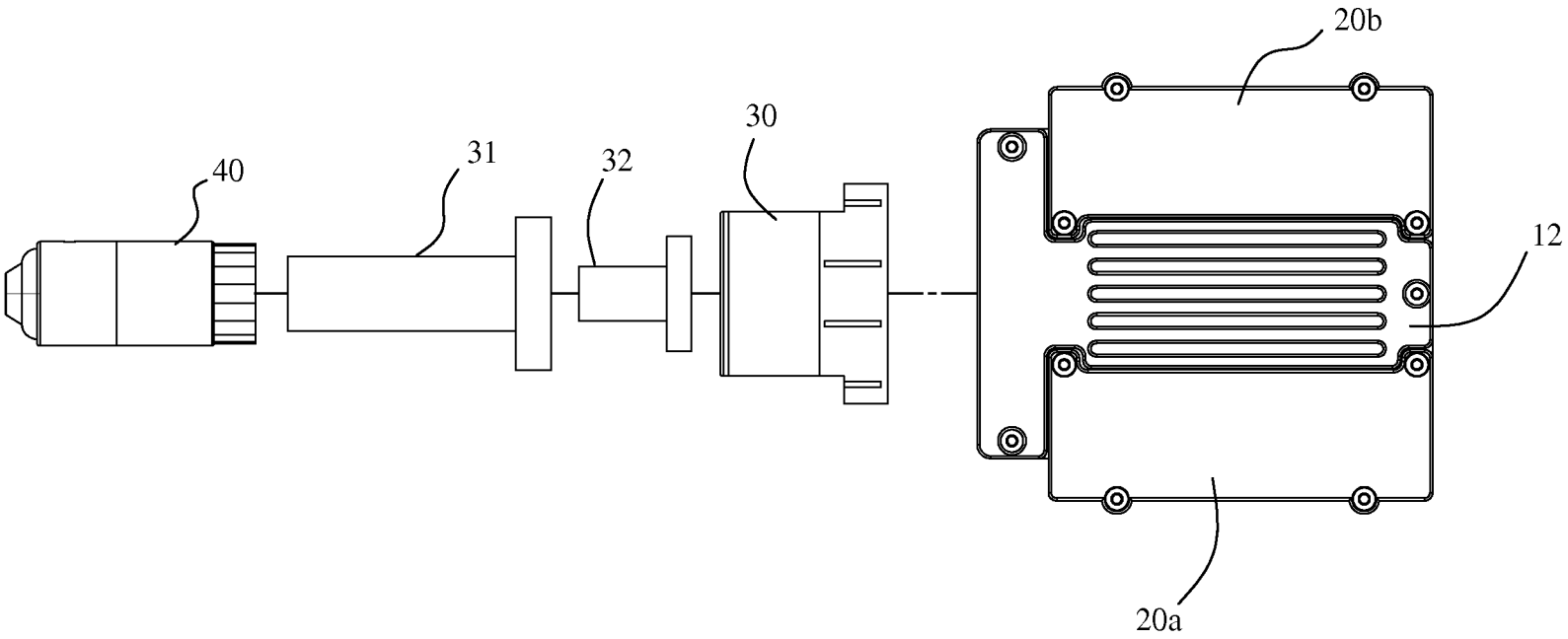
FIG. 7 is a side view of the outdoor LED lighting device of FIG. 4.

An outdoor LED lighting device of a second embodiment of the present invention is shown in FIGS. 5, 6 and 7. The driver modules 20*a*, 20*b* are disposed at different locations with respect to the first embodiment. In the condition of the input power is regulated, the driver modules 20*a*, 20*b* may be eliminated.

Figure 9A:
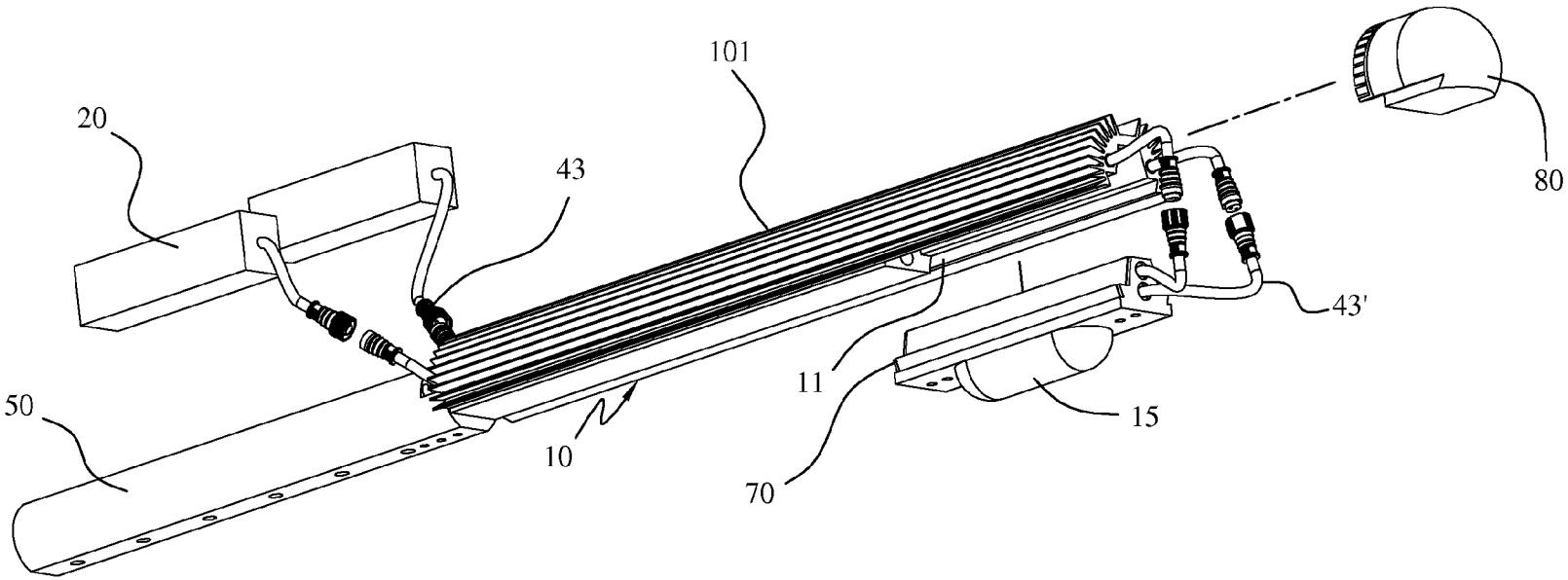
FIGS. 9A and 9B are perspective views of the outdoor LED lighting device of a third preferred embodiment of the present invention.
Figure 9B:
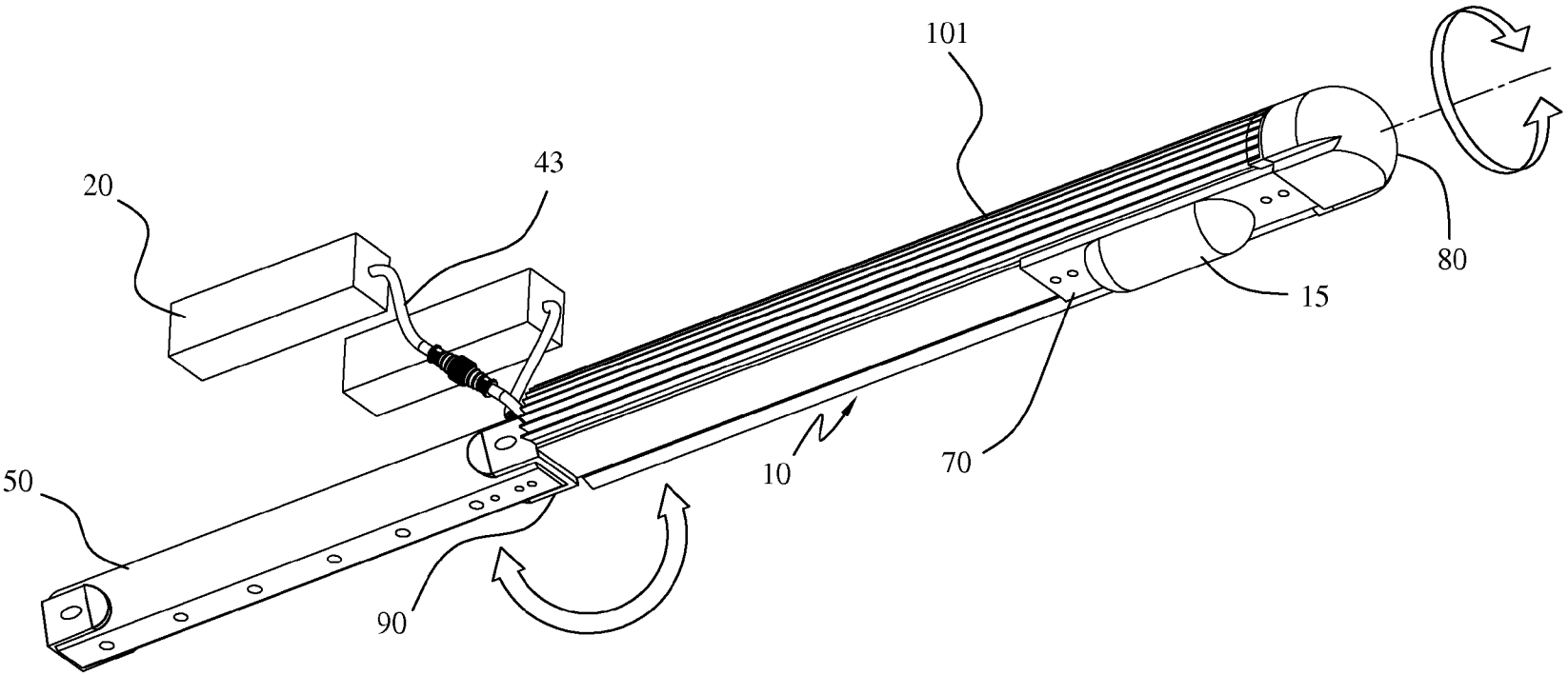

Please refer to FIGS. 9A and 9B, the outdoor LED lighting device of a forth preferred embodiment of the present invention includes a casing 10, a light emitting module 70, a driver module 20 and a supporter 50. A hollow space 11 is provided in the casing 10 and an auxiliary fin type heat sink 101 is provided at an outer surface of the casing 10. The light emitting module 70 is detachably disposed in the hollow space 11 of the casing 10 and contacted to the casing 10 to dissipate heat generated by the light emitting module 70 through the auxiliary fin type heat sink 101. The driver module 20 is electrically connected to the light emitting module 70 by the waterproof cable joints 43. 43'. The supporter 50 is disposed on one end of the casing 10. Therefore, the LED lighting device may be installed easily by the supporter 50 in a housing of the conventional outdoor lamp without having to discard the whole set of the conventional outdoor lamp, thus eliminating the unnecessary waste, in achieving cost-effectiveness and environment protection. A front cover 80 disposed on the casing 10 to protect the waterproof cable joint 43'. A lamp cover 15 disposed on the light emitting module 70.

Figure 10A:
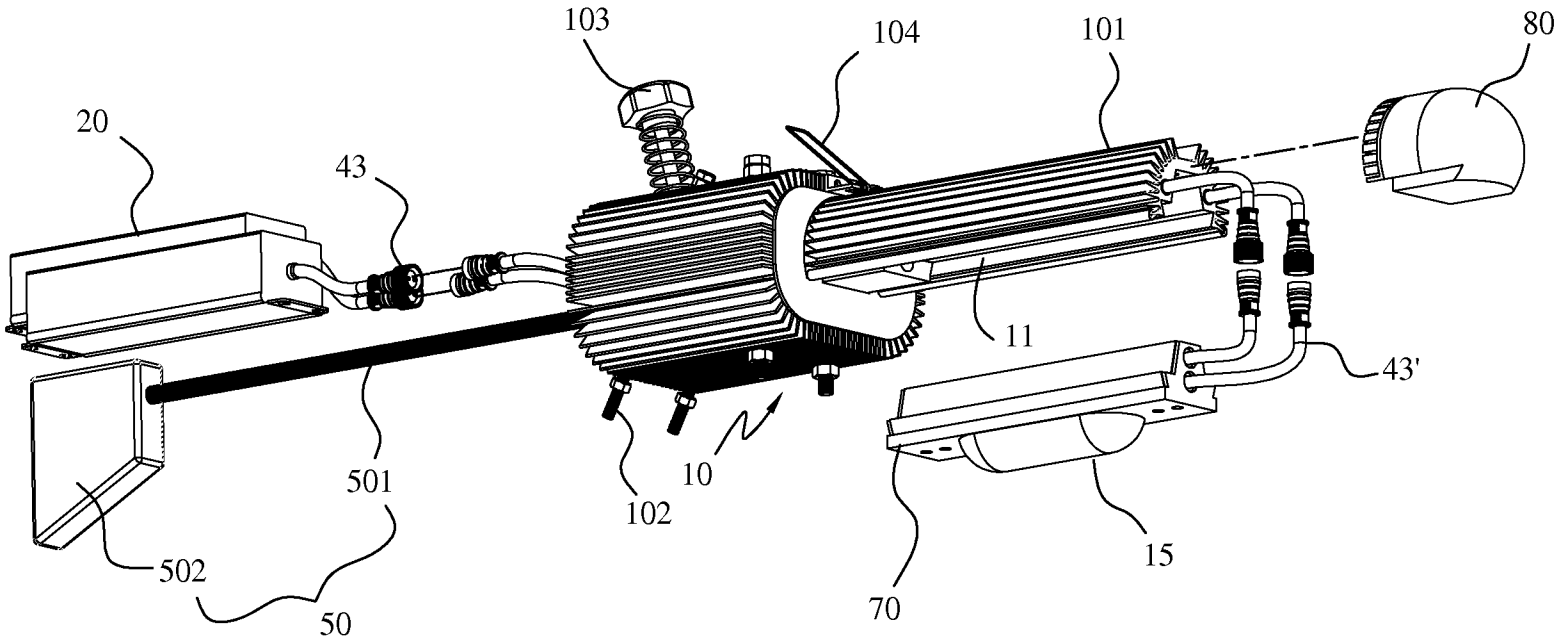
FIGS. 10A and 10B are perspective views of the outdoor LED lighting device of a forth preferred embodiment of the present invention.
Figure 10B:
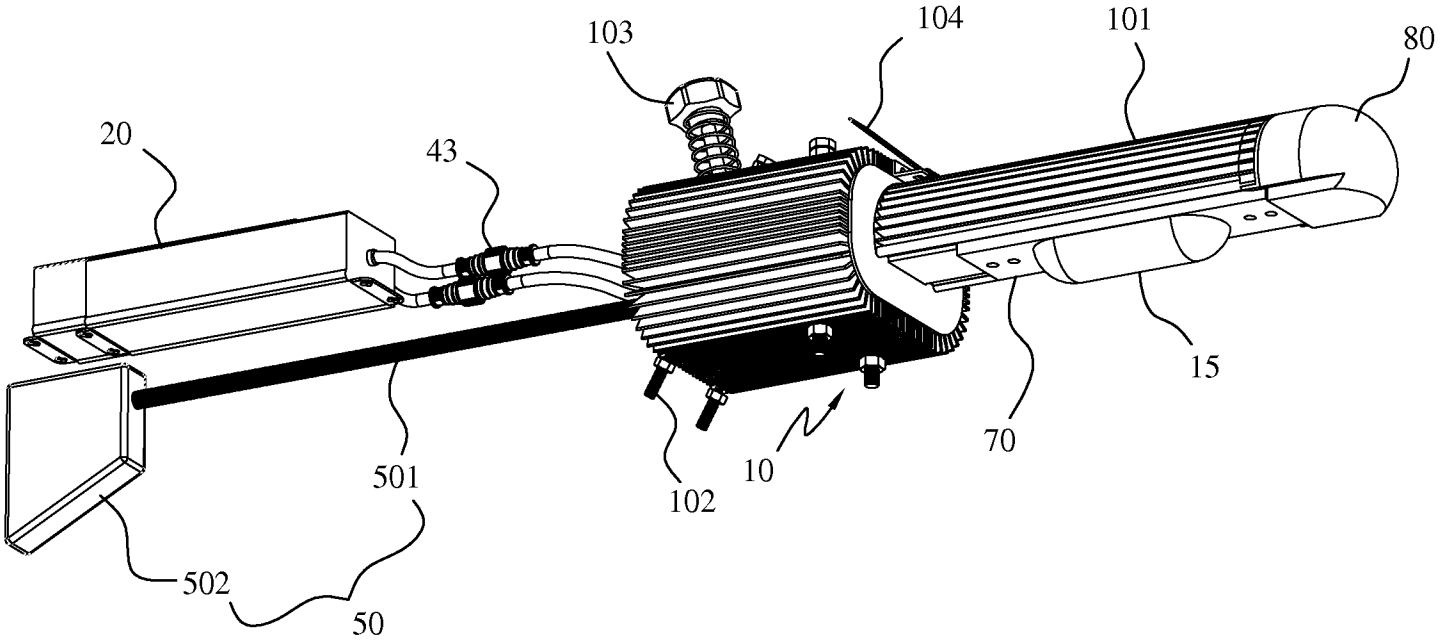

In this embodiment, the supporter 50 is a column-like structure. Please refer to FIGS. 10A and 10B, the outdoor LED lighting device of a forth preferred embodiment of the present invention. The supporter 50 includes a threaded rod 501 and a connected block 502. Therefore, the length of the supporter 50 may be adjusted to fit to the housing of the conventional outdoor lamp. Also, the casing 10 further includes a screwed pillar 51, an elastic clip 52 and a screwed bolt assembly 53. Therefore, the light emitted angle may be modified. Please refer to FIG. 9B, the support 50 is connected to the casing 10 by a hinge 90 to rotate and swing relatively to the casing 10 to modify the angle of the emitted light.

Moreover, a solar battery module may be included to lower environmental impact without carbon dioxide emissions during power generation.

The casing 10 may be disposed directly in the housing 91 of the outdoor lamp, rather than via the supporter as above-mentioned. Please refer to FIGS. 11A and 12, the flange 102 is extended from two sides of the casing 10. The flange 102 has more than one through holes 1021 and the screws 103 are used to pass through the through holes 1021 to fix in the fixing holes 93 of the housing 91 for fixing the casing 10 in the housing 91. The light emitting module 70 is exposed from the slot hole 92 of the housing 91 to emit the light.

Figure 11A:
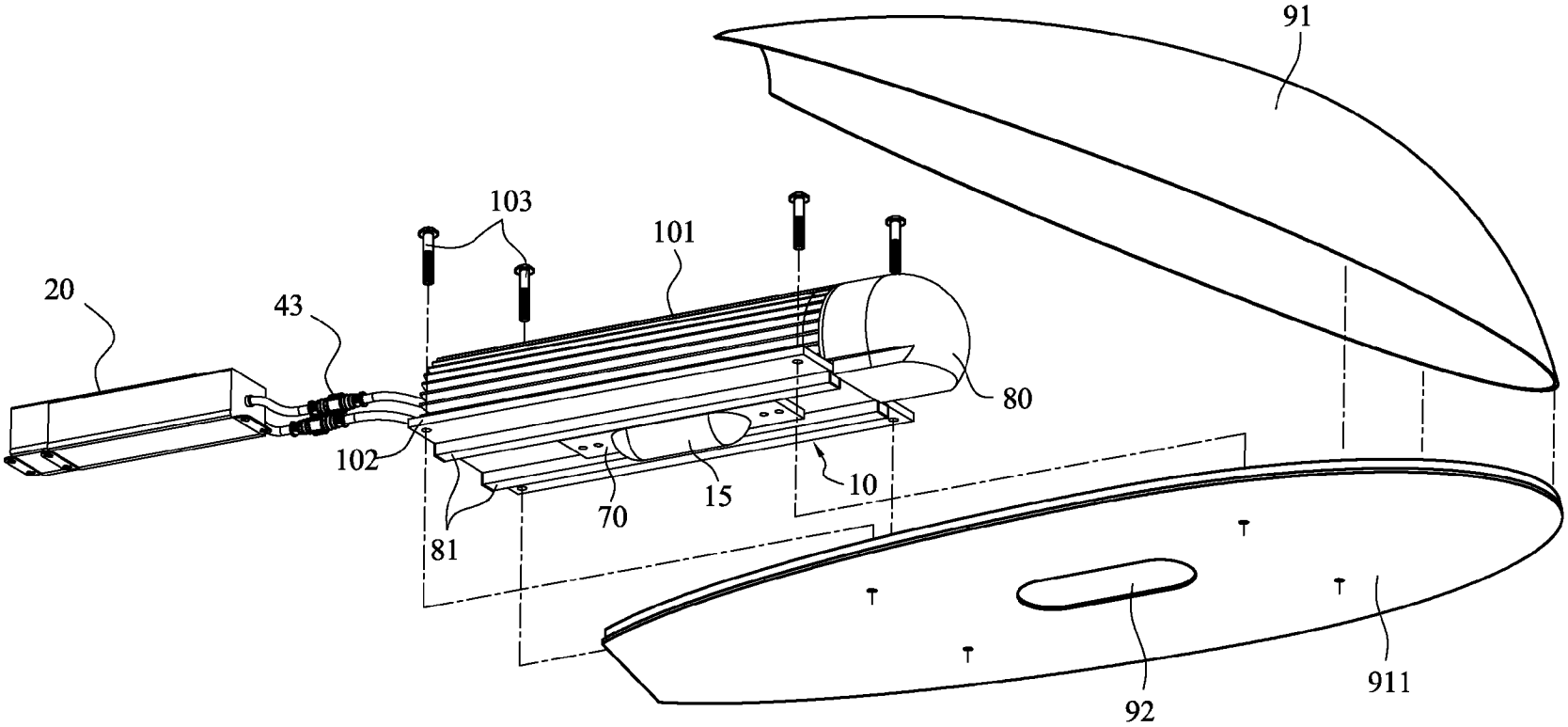
FIGS. 11A and 11B are perspective views of the outdoor LED lighting device of a fifth preferred embodiment of the present invention.
Figure 11B:
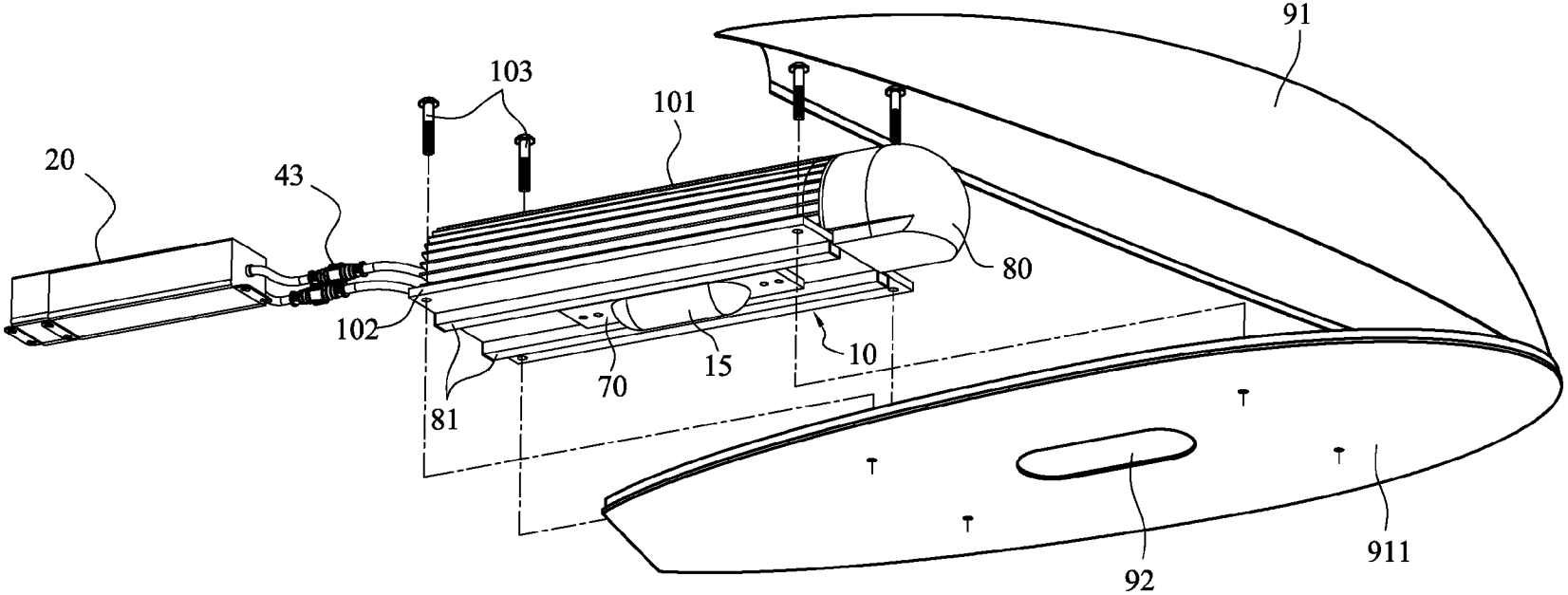
Figure 12:
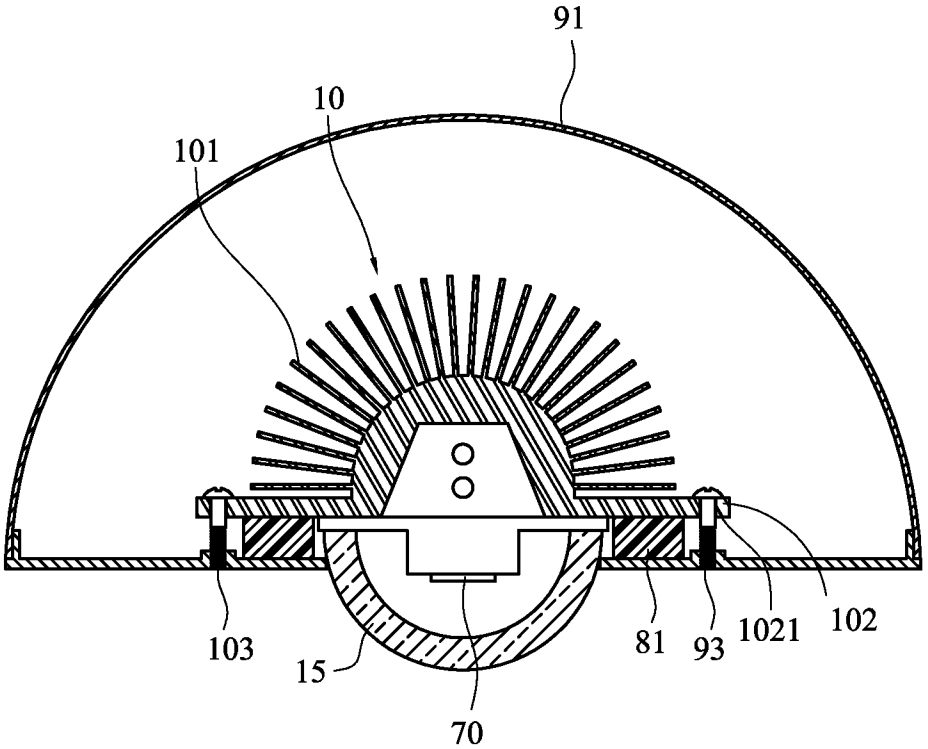
FIG. 12 is a cross-sectional view of the outdoor LED lighting device of a fifth preferred embodiment of the present invention.

Please refer to FIG. 11A, the housing 91 may be a housing of the conventional outdoor lamp. A housing plate 911 with the fixing holes 93 is attached to the housing 91 by fixing clamps, spring clips, tight-fitting, screws or etc. Moreover, please see FIG. 11B, the housing plate 911 may be integrated to the housing 91 by the pivot.

Figure 13A:
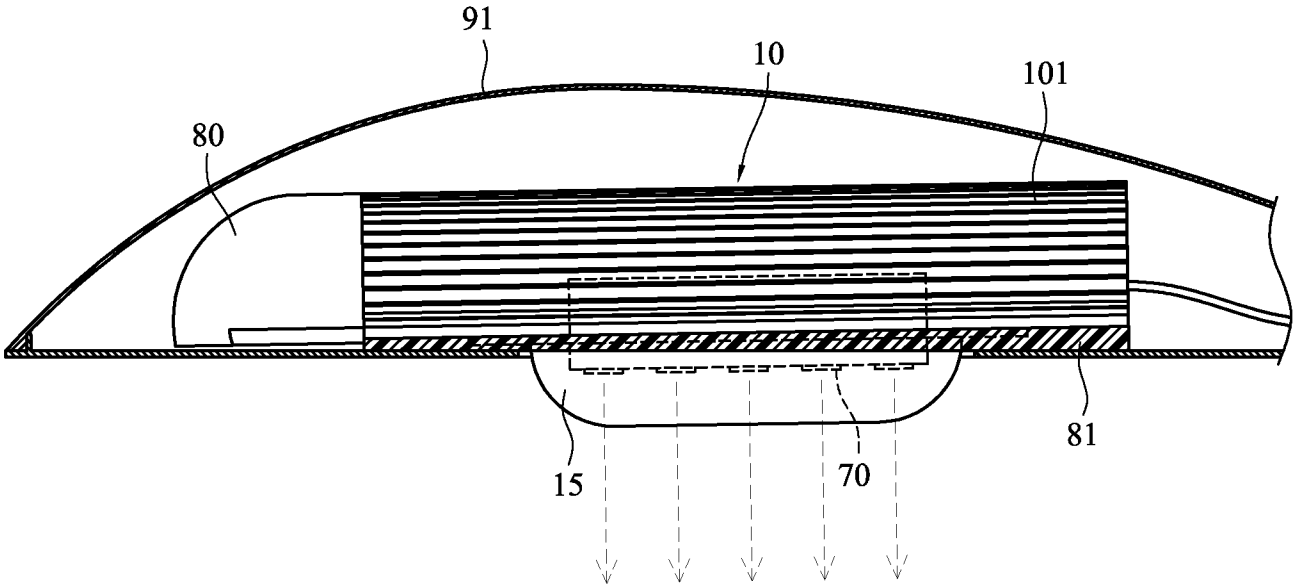
FIGS. 13A and 13B are perspective views of the outdoor LED lighting device of FIG. 12, showing the illumination angle of the light emitting module is modified.
Figure 13B:
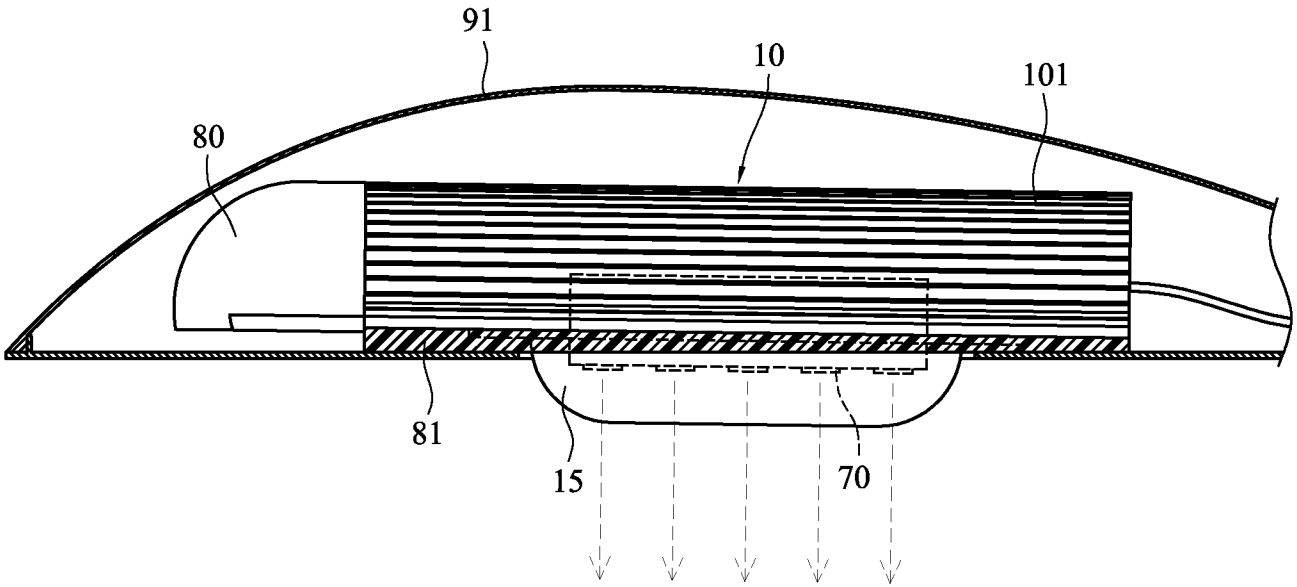
Figure 14A:
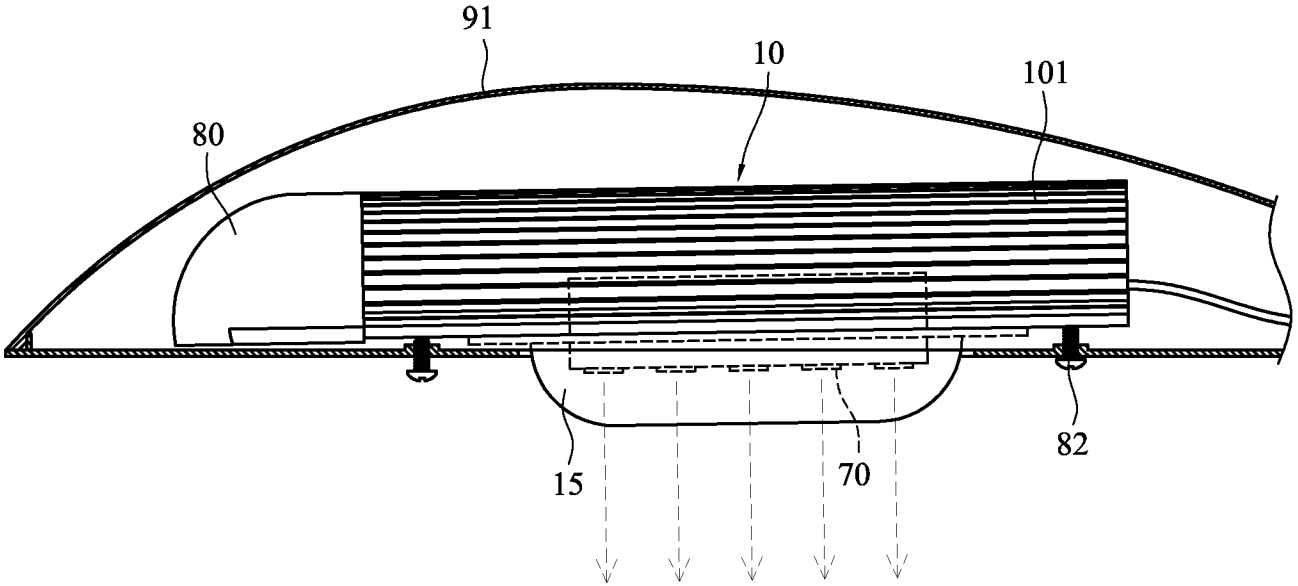
FIGS. 14A and 14B are perspective views of another embodiment of the outdoor LED lighting device, showing the illumination angle of the light emitting module is modified.
Figure 14B:
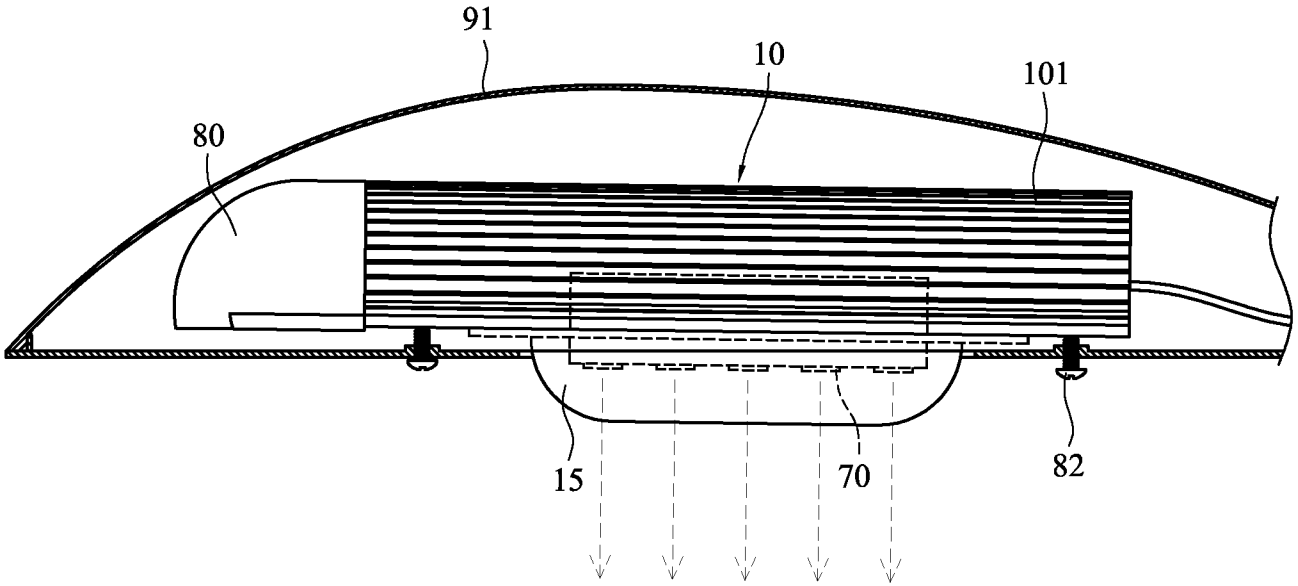

The outdoor LED lighting device further includes an illumination angle adjuster, disposed on the casing 10 to modify the illumination angle of the light emitting module 70. In this embodiment, the illumination angle adjuster is two sticks 81 extended from the casing 10. The illumination angle of the light emitting module 70 is changed by modifying the thickness of the sticks 81, please see FIGS. 13A and 13B. Furthermore, the illumination angle adjuster may include at least one screw 83, please see FIGS. 14A and 14B. By tightening or loosening the screw 83, the illumination angle of the light emitting module 70 is changed.

Accordingly, the present invention provides an outdoor LED lighting device which has good characteristics of thermal dissipation and waterproof. The outdoor LED lighting device can also have a prolonged service life and decreased light fade. Also, the outdoor LED lighting device has simplified structure. The light materials, such as plastic or aluminum, may be used to reduce the material costs and to mass-produce easily. The modular design of the outdoor LED lighting device eases maintenance and tends to lower costs of maintenance as a failed light emitting module, or a driver module is easy to replace and is less expensive to replace than replacement of the entire lamp.

The outdoor LED lighting device may be installed in a housing of the conventional outdoor lamp without having to discard the whole set of the conventional outdoor lamp, thus eliminating the unnecessary waste, in achieving cost-effectiveness and environment protection. Also, the outdoor LED lighting device may be used as a street light alone without being disposed the conventional housing. The waterproof structure is applied in the driver module, between the connecting module and the connecting base, between the casing and the lamp cover, and between the connecting base and the lamp socket of the conventional outdoor lamp. The whole outdoor LED lighting device has excellent waterproof effect. Therefore, the outdoor LED lighting device still works well after being exposed to outside for a long period of time. Moreover, the solar battery module may be included to lower environmental impact without carbon dioxide emissions during power generation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An outdoor LED (light emitting diode) lighting device, adapted to dispose in a housing of an outdoor lamp, comprising:

a casing, adapted to fix to the housing, wherein a hollow space is provided in the casing and an auxiliary fin type heat sink is provided at an outer surface of the casing;

a light emitting module, detachably disposed in the hollow space of the casing and contacted to the casing to dissipate heat generated by the light emitting module through the auxiliary fin type heat sink;

a driver module, electrically connected to the light emitting module by a waterproof cable joint; and an illumination angle adjuster, disposed on the casing to modify the illumination angle of the light emitting module.

2. The outdoor LED lighting device of claim 1, wherein the casing is fixed to the housing by screws.

3. The outdoor LED lighting device of claim 1, further comprising a front cover disposed on the casing to protect the waterproof cable joint.

4. The outdoor LED lighting device of claim 1, further comprising a lamp cover disposed on the light emitting module.

5. The outdoor LED lighting device of claim 1, wherein the illumination angle adjuster includes two sticks extended from the casing, wherein the illumination angle of the light emitting module is changed by modifying the thickness of the sticks.

6. The outdoor LED lighting device of claim 1, wherein the illumination angle adjuster includes at least one screw.

* * * * *